United States Patent [19]

Buckwalter et al.

[11] 4,231,743

[45] Nov. 4, 1980

[54] PROCESS FOR SHADING DURING THE VAPOR PHASE DYEING OF CARPET

[75] Inventors: Mervin R. Buckwalter; Walter T. Bulson; Leonard N. Ray, Jr., all of Lancaster, Pa.

[73] Assignee: Armstrong Cork Company, Lancaster, Pa.

[21] Appl. No.: 30,450

[22] Filed: Apr. 16, 1979

Related U.S. Application Data

[63] Continuation-in-part of Ser. No. 694,763, Jun. 10, 1976, Pat. No. 4,181,497.

[51] Int. Cl.[3] ..... D06P 5/12

[52] U.S. Cl. ..... 8/471; 101/470; 8/472

[58] Field of Search ..... 8/2.5 A; 101/470

[56] References Cited

U.S. PATENT DOCUMENTS

| | | | |
|---|---|---|---|
| 3,649,332 | 3/1972 | Dybvig | 117/38 |
| 3,782,896 | 1/1974 | Defago et al. | 8/2.5 |
| 3,949,574 | 4/1976 | Glover | 68/5 C |

FOREIGN PATENT DOCUMENTS

| | | | |
|---|---|---|---|
| 1380724 | 1/1975 | United Kingdom | 8 UX/2.5 A |

*Primary Examiner*—Stanford M. Levin

[57] ABSTRACT

A process is disclosed for the making of a decorative carpet through the use of sublimable dyes. A shading effect is secured through the use of air flow control sheets that affect the flow of air through a transfer sheet and a carpet product adjacent thereto. By lessening air flow, the intensity of dye being transferred is also lessened so that shades of a certain color can be secured.

3 Claims, 1 Drawing Figure

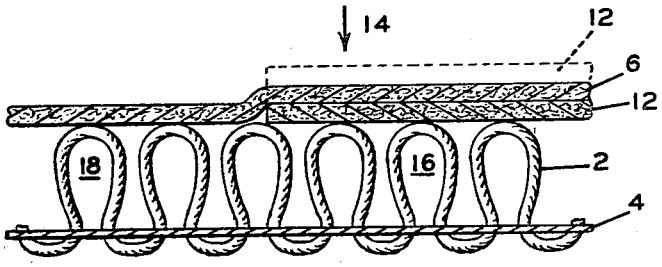
14
12
6
12
18
16
2
4

PROCESS FOR SHADING DURING THE VAPOR PHASE DYEING OF CARPET

CROSS-REFERENCE TO RELATED APPLICATION

This application is a continuation-in-part of U.S. Application Ser. No. 694,763, now U.S. Pat. No. 4,181,497 filed June 10, 1976 and entitled "Process for Shading During the Vapor Phase Dyeing of Carpet."

BACKGROUND OF THE INVENTION

1. Field of the Invention

The invention is directed to a process for making carpet and, more particularly, to a process for using sublimable dyes to provide a design to a carpet.

2. Description of the Prior Art

The use of sublimable dyes for dyeing carpet is old in the art. In U.S. Pat. No. 3,860,388, there is taught the use of a sheet between the product being dyed and the transfer sheet. The sheet in question is used to eliminate the problem of sticking of the transfer sheet to the material being printed.

It is believed that the prior art lacks the teaching of using an air flow to carry out the transfer of the sublimable dyes from the transfer sheet to a carpet. Further, it is submitted that the prior art lacks the use of a shading means which limits air flow in certain areas so that dye intensity is diminished in those areas.

SUMMARY OF THE INVENTION

The invention is a process for making a decorative carpet through the use of sublimable dyes. The sublimable dyes are placed on a porous transfer sheet. The porous transfer sheet is then placed adjacent the face fiber yarns of a carpet. A shade controlling means is then positioned relative the transfer sheet and the carpet product. The shade controlling means is a porous member which is placed adjacent the transfer sheet. It may be placed between the transfer sheet and the carpet. This shade controlling sheet is porous and its porosity is so controlled so that it limits the amount of air passing through the shade controlling means, the transfer sheet, and the carpet. By limiting the air flow, the rate of dye transfer is reduced and consequently, the intensity of the color placed on the carpet is lessened. The dye transfer process requires the use of air to move the dye from the transfer sheet to the carpet. In selected areas of the carpet, the shade controlling means lessens the air flow and consequently, the dye is transferred but at a lesser dye intensity at the points where the shade controlling means exist. This then provides a difference in shade of color between those areas where the shade controlling means exist and those areas where the shade controlling means does not exist with respect to a certain color being transferred.

BRIEF DESCRIPTION OF THE DRAWINGS

The FIGURE is a cross-sectional view of a carpet structure with the shade controlling means positioned adjacent the dye transfer sheet.

DESCRIPTION OF THE PREFERRED EMBODIMENTS

Referring now to the FIGURE, there is provided a conventional carpet with face fiber yarns 2 and a backing 4. A transfer sheet 6 is likewise utilized. A shade controlling means 12 is then positioned either between sheet 6 and face fiber yarns 2 or on the back side of sheet 6 away from the side of sheet 6 engaging the face fiber yarns 2 (shown in dotted lines). The sheet 12, which functions as a shade controlling means, is a porous sheet. Air moves in the direction of arrow 14 to cause the transfer of the sublimable dyes from sheet 6 to the face fiber yarns 2. The existence of the porous sheet 12 lessens the air flow and thus the intensity of the dye being transferred. Consequently, less dye is transferred where the shade controlling means is utilized and, therefore, the shade difference is secured in those areas 16 where a shade controlling means is utilized versus those areas 18 where no shade controlling means is utilized.

A series of examples were carried out to determine the shading characteristics obtainable when various porous barrier sheets are located either between the transfer sheet and the carpet or on the side of the transfer sheet opposite from the side of the transfer sheet engaging the carpet face fiber yarns. Eight porous shade controlling means in the form of sheets were formed to provide both a range of porosity and a selection of different materials. The materials utilized are as follows:

| Shade Controlling Means | Permeability (Standard cubic feet per minute per square foot-SCM/ft.$^2$ per ASTM D-737-46) | |
|---|---|---|
| | One Thickness | Two Thicknesses |
| Reemay 2014 (Polyester) | 859 | 500 |
| Reemay 2033 (Polyester) | 240 | 140 |
| Glass Paper (E-35-S61-58) | 208 | 113 |
| Haines 186F (Cellulose) | 32 | 19 |

A transfer sheet is provided with a sublimable dye. The transfer sheet is glass paper having a porosity of 208 SCFM/ft.$^2$. The sublimable dye used is a standard sublimable dye, for example, a 15% solution of latyl cerise dye in water. The particular dye utilized is CI Constitution No. 60756. It is deposited on the transfer sheet by a conventional rotogravure printer having 120 lines per inch. A carpet structure is then provided formed with a backing of jute material having a 19 by 19 count. On the backing material there is tufted a Nylon 66 yarn to a pile height of 5/16 inches to provide a carpet face weight of 13 ounces per square yard. The yarn is tufted into the backing at the rate of 12 tufts per inch.

Between the above-described transfer sheet and carpet structure there is inserted one example of each of the above-identified controlling means. Air at 425° F. and 15 standard cubic feet per minute per square foot is then passed through this multi-layer structure for one minute.

A second set of shade controlling means, one each of the above-identified shade controlling means, is positioned on the side of the transfer sheet away from the side of the transfer sheet engaging the face fiber yarns of the carpet structure. Air is now passed through the shade controlling means, the transfer sheet, and the carpet in this respective order at a temperature of 425° F. and 15 standard cubic feet per minute per square foot. In both above examples, certain portions of the transfer sheet and carpet structure contain no shade controlling means and other portions contain shade controlling means.

As a result of carrying out the above examples, it was noted that shading effects begin to show at a porosity of 859 SCFM/ft.$^2$ when the shade controlling means is placed between the transfer sheet and the carpet. The shading becomes lighter as the porosity of the shade controlling means is reduced, and at a porosity of 140 SCFM/ft.$^2$, the carpet area where a shade controlling means exists is not colored by any of the sublimable dyes from the transfer sheet. In those areas where there is no shade controlling, the dye is transferred and covers the full length of the carpet face fibers. The shading effect is measured visibly with reference to those areas of the transfer sheet-carpet construction that has no shade controlling means and is subject to the same air flow conditions, and thus yields the dye transfer of a certain intensity which is considered to be the control intensity.

Shading effects begin to show at a porosity of 208 SCFM/ft$^2$ when the shade controlling means is placed in front of the transfer sheet. That is, on the side of the transfer sheet away from the side of the transfer sheet contacting the face fiber yarns. The shading becomes lighter as the porosity of the shade controlling means is reduced, and at a porosity of 32 SCFM/ft.$^2$, the carpet area adjacent the shade controlling means is not colored by the dye. Again, where there was dye transferred there is evidence of the transfer of the dye over the full length of the carpet fibers, and the shading is measured visibly relative to portions of the carpet dyed without the presence of a shade controlling means.

The materials used to form the shade controlling means may have a slight influence on the final result. The Reemay material (polyester material) absorbs more dye than the glass paper. However, the porosity of the barrier sheet is the factor that has the greatest significant effects on the final results.

The shade controlling means may have uniform porosity. It is also possible for the shade controlling means to have areas of different porosities in the form of a pattern. In still another form, the shade controlling means may have an interrupted pattern. The shade controlling means is not a mask or resist that reduces the dye intensity to zero. The invention herein requires that some dye be transferred but that its intensity be lessened.

What is claimed is:

1. A process for making a decorative carpet through the use of sublimable dyes comprising the steps of:

(a) printing sublimable dyes on a porous transfer sheet, (b) preparing a carpet product which has on one side thereof carpet yarn forming the face fiber yarns, (c) placing the transfer sheet adjacent the face fiber yarns so that the transfer sheet with the sublimable dyes printed thereon will be adjacent the face fiber yarns of the carpet product, (d) positioning a shade controlling means which is a porous sheet adjacent a portion of the transfer sheet to reduce the air flow permeability through the transfer sheet and carpet product so as to yield dye, but at a reduced intensity in those areas where the shade controlling means exists, and (e) transferring the sublimable dyes from the transfer sheet to the carpet face yarns by the application of a directional flow, heated gaseous medium, passing through the transfer sheet and the carpet product in the direction from the transfer sheet towards the face fiber yarns with the areas not containing the shade controlling means resulting in full color transfer of dye from the transfer sheet to the face fiber yarns of the carpet product and with those areas containing the shade controlling means there being a diminishing of dye intensity, but still dyeing, on the face fiber yarns of the carpet product, resulting in partial color transfer of dye to the face fiber yarns to give a shade difference between the areas with and those without the shade controlling means.

2. A process for making a decorative carpet through the use of sublimable dyes as set forth in claim 1 wherein the shade controlling means is a porous sheet positioned on the side of the transfer sheet away from the carpet product and said porous sheet has a porosity of less than 208 and more than 32 SCFM/ft.$^2$.

3. A process for making a decorative carpet through the use of sublimable dyes as set forth in claim 1 wherein the shade controlling means is a porous sheet positioned between the transfer sheet and the carpet structure and the porous sheet has a porosity between 859 and 140 SCFM/ft.$^2$.

* * * * *